US010710359B2

(12) United States Patent
Zhang et al.

(10) Patent No.: US 10,710,359 B2
(45) Date of Patent: Jul. 14, 2020

(54) SCREEN PRINTING DEVICE AND SCREEN PRINTING METHOD

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Kang Zhang, Beijing (CN); Yuhong Zhou, Beijing (CN); Duling Qin, Beijing (CN); Chengpeng Li, Beijing (CN); Qian Qu, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu (CN)

( * ) Notice: Subject to any disclaimer, the term of this patent is extended or adjusted under 35 U.S.C. 154(b) by 241 days.

(21) Appl. No.: 15/561,803

(22) PCT Filed: Apr. 17, 2017

(86) PCT No.: PCT/CN2017/080793
§ 371 (c)(1),
(2) Date: Sep. 26, 2017

(87) PCT Pub. No.: WO2018/036175
PCT Pub. Date: Mar. 1, 2018

(65) Prior Publication Data

US 2018/0244036 A1 Aug. 30, 2018

(30) Foreign Application Priority Data

Aug. 25, 2016 (CN) ..... 2016 1 0728846

(51) Int. Cl.
*B41F 15/08* (2006.01)
*B41F 15/36* (2006.01)
(Continued)

(52) U.S. Cl.
CPC ..... *B41F 15/08* (2013.01); *B41F 15/36* (2013.01); *B41F 15/40* (2013.01); *B41M 1/12* (2013.01); *B41M 1/125* (2013.01)

(58) Field of Classification Search
CPC ..... B41F 15/08; B41F 15/36; B41F 15/40; B41M 1/12; B41M 1/125; B41M 1/42
See application file for complete search history.

(56) References Cited

U.S. PATENT DOCUMENTS 3,450,043 A 6/1969 Flax
5,355,794 A * 10/1994 Freudenheim ..... B41M 1/125 101/129
(Continued)

FOREIGN PATENT DOCUMENTS

CN 1511086 A 7/2004
CN 201030667 Y 3/2008
(Continued)

OTHER PUBLICATIONS

International Search Report and Written Opnion dated Jul. 19, 2017; PCT/CN2017/080793.

*Primary Examiner* — Matthew G Marini
*Assistant Examiner* — Marissa Ferguson-Samreth

(57) ABSTRACT

A screen printing device and a screen printing method are provided. The screen printing device includes a screen plate and an electrifying device, the screen plate includes a conductive mesh; and the electrifying device is electrically connected with the conductive mesh and configured to apply voltage to the conductive mesh. The screen printing method includes: adopting a printing head to rub against a screen
(Continued)

plate to print ink onto a substrate for silk screen printing, wherein the screen plate includes a conductive mesh; and applying voltage with positive or negative polarity to the conductive mesh in the screen printing process.

16 Claims, 4 Drawing Sheets

(51) Int. Cl.
*B41M 1/12* (2006.01)
*B41F 15/40* (2006.01)

(56) References Cited

U.S. PATENT DOCUMENTS

| | | | | |
|---|---|---|---|---|
| 2004/0160505 | A1 | 8/2004 | Ando | |
| 2011/0318500 | A1 | 12/2011 | Kawaoka | |
| 2017/0144429 | A1* | 5/2017 | Fukui | B41M 1/42 |

FOREIGN PATENT DOCUMENTS

| | | | |
|---|---|---|---|
| CN | 102348511 | A | 2/2012 |
| CN | 202727532 | A | 2/2013 |
| CN | 204123759 | U | 1/2015 |
| CN | 106379037 | A | 2/2017 |
| JP | 2014-208405 | A | 11/2014 |

* cited by examiner

SCREEN PRINTING DEVICE AND SCREEN PRINTING METHOD

TECHNICAL FIELD

At least one embodiment of the present disclosure relates to a screen printing device and a screen printing method.

BACKGROUND

In the process of screen printing and operation, as static electricity on surfaces of materials and static electricity produced by friction will affect normal inking in the printing process and result in stencil clogging, a substrate will be caught by a screen mesh at the moment of output and will even break down a circuit which has been already formed and damage a product.

SUMMARY

At least one embodiment of the present disclosure relates to a screen printing device and a screen printing method, which can prevent the generation of static electricity.

At least one embodiment of the present disclosure provides a screen printing device, comprising a screen plate and an electrifying device, wherein the screen plate includes a conductive mesh; and the electrifying device is electrically connected with the conductive mesh and configured to apply voltage to the conductive mesh.

In some examples, in a screen printing process, a polarity of the voltage applied to the conductive mesh by the electrifying device is a first polarity; a polarity of electrostatic charges on a substrate in the screen printing process upon the conductive mesh being not electrified is a second polarity; and the first polarity is opposite to the second polarity.

In some examples, in the screen printing process, an absolute value of the voltage applied to the conductive mesh by the electrifying device is directly proportional to a charge quantity of the electrostatic charges.

In some examples, the screen plate further includes a conductive screen frame; and the conductive mesh is disposed in the conductive screen frame and electrically connected with the conductive screen frame.

In some examples, the conductive screen frame is fixed through a screen frame mounting bracket.

In some examples, the screen frame mounting bracket includes a conductive portion; the electrifying device is electrically connected with the conductive portion of the screen frame mounting bracket through a lead; and the conductive portion of the screen frame mounting bracket is electrically connected with the conductive screen frame.

In some examples, the screen printing device further comprises a printing head, wherein the printing head is configured to print ink onto the substrate through the screen plate.

In some examples, the conductive mesh includes a metal wire mesh.

In some examples, the screen printing device further comprises a signal generator, wherein the signal generator is connected with the electrifying device to control a polarity and time of the voltage applied to the conductive mesh by the electrifying device.

In some examples, the screen printing device further comprises a bearing table for supporting the substrate in the screen printing process, wherein the bearing table is configured to be grounded.

In some examples, the signal generator is configured to control the polarity of the voltage applied by the electrifying device in the screen printing process to be opposite to the polarity of the voltage applied in a process of placing the substrate on the bearing table and in a process of separating the substrate from the bearing table.

In some examples, the screen printing device further comprises a detector, wherein the detector is configured to detect the polarity and the charge quantity of the electrostatic charges on the substrate in the screen printing process upon the conductive mesh being not electrified.

At least one embodiment of the present disclosure provides a screen printing method, comprising: adopting a printing head to rub against a screen plate to print ink onto a substrate for silk screen printing, wherein the screen plate includes a conductive mesh; and applying voltage to the conductive mesh in the screen printing process.

In some examples, the screen printing method further comprises applying positive voltage or negative voltage to the conductive mesh in a process of placing the substrate on a bearing table and/or in a process of separating the substrate from the bearing table.

In some examples, voltage with different polarities is respectively applied to the conductive mesh at different moments.

In some examples, one of the positive voltage and the negative voltage is applied to the conductive mesh in the screen printing process.

In some examples, the other of the positive voltage and the negative voltage is applied to the conductive mesh in the process of placing the substrate on the bearing table and in the process of separating the substrate from the bearing table.

In some examples, the screen printing method further comprises: before applying the voltage to the conductive mesh, adopting the ink for silk screen printing upon the conductive mesh being not electrified, and measuring the polarity of electrostatic charges on the substrate.

In some examples, the polarity of the voltage applied to the conductive mesh in the screen printing process is opposite to the polarity of the electrostatic charges.

In some examples, an absolute value of the voltage applied to the conductive mesh in the screen printing process is directly proportional to the charge quantity of the electrostatic charges.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiment will be described in a clearly and fully understandable way in connection with the drawings related to the embodiments of the disclosure. It is obvious that the described embodiments are just a part but not all of the embodiments of the disclosure. Based on the described embodiments herein, those skilled in the art can obtain other embodiment(s), without any inventive work, which should be within the scope of the disclosure.

Unless otherwise defined, the technical terminology or scientific terminology used herein should have the general meanings understood by those skills in the art to which the present disclosure belongs. The "first", "second" and similar words used in the present disclosure application specification and claims do not mean any sequence, amount or importance, but are merely used to distinguish different components. Likewise, the word "comprise", "include" or the like only indicates that an element or a component before the word contains elements or components listed after the word and equivalents thereof, not excluding other elements or components. "Connecting" or "connected" and similar words are not limited to the physical or mechanical connection, but may comprise electrical connection, no matter directly or indirectly. "Over", "under", "right", "left" and the like are merely used to denote the relative location relationship which based on the relationship described in drawings, and only to describe the present disclosure conveniently.

Static electricity must be eliminated in the screen printing process. It is more urgent to eliminate static electricity especially in the case of applying the screen printing process in the fields with high requirement on static electricity, e.g., thin-film transistor liquid crystal display (TFT-LCD), organic light-emitting diode (OLED) and printed circuit board (PCB). The usual method is to control the static electricity by controlling the temperature, the humidity and the like of a workshop, but this method has low control reliability and the control is more difficult especially in areas with low humidity.

One feasible means is to eliminate the static electricity by ionic wind. However, as most ink solvent has volatility and air flow will accelerate its volatilization, especially when one thin layer of ink solvent covers the screen plate, ink setting tends to occur, resulting in stencil clogging and poor printing quality.

Another feasible means is to conduct away the static electricity through a conducting rod. However, when ink is an insulator, a wire mesh of a metal screen plate is full of insulating ink and cannot play a role of conducting away the static electricity, so this means will fail in this case.

Figure 1A:
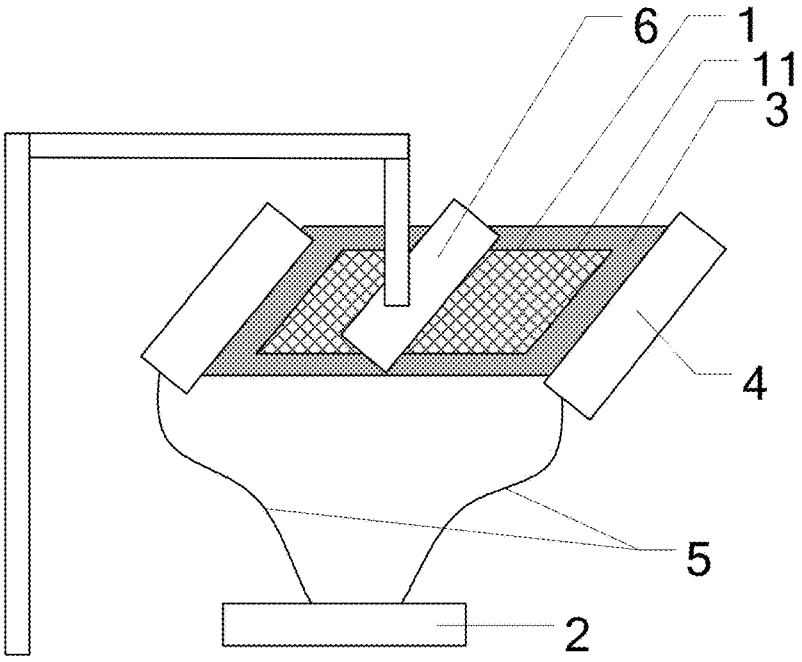
FIG. 1*a* is a schematic diagram of a screen printing device provided by one embodiment of the present disclosure.
Figure 4:
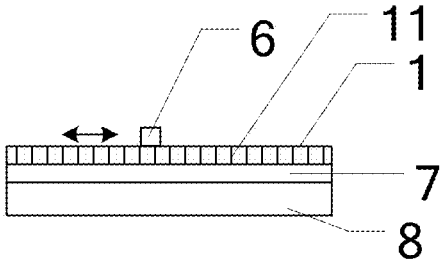
FIG. 4 is a schematic diagram illustrating the process of adopting a printing head to rub against a screen plate in a screen printing method provided by one embodiment of the present disclosure.

At least one embodiment of the present disclosure provides a screen printing device, which, as illustrated in FIG. 1*a*, comprises a screen plate 1 and an electrifying device 2. The screen plate 1 includes a conductive mesh 11. The electrifying device 2 is electrically connected with the conductive mesh 11 and configured to apply voltage to the conductive mesh 11. For example, the screen printing device further comprises a printing head 6 which is configured to print ink onto a substrate through the screen plate 1. For example, the conductive mesh 11 includes but not limited to a wire mesh. The screen printing device is configured to adopt the printing head 6 to rub against the screen plate 1 to print the ink onto the substrate 7 for silk screen printing (as illustrated in FIG. 4).

In the screen printing process, static electricity tends to occur when the printing head is adopted to rub against the screen plate; the static electricity, for example, may be produced among the printing head, the screen plate, the ink and the substrate; and considering that the printing head, the screen plate and the ink have high antistatic effect, the embodiment of the present disclosure mainly focuses on the impact of electrostatic charges on the substrate. If positive voltage or negative voltage is applied to the conductive mesh 11 by the electrifying device 2 in the process of adopting the printing head to rub against the screen plate, as the positive voltage may absorb electrons and the negative voltage may repel the electrons, the gains and losses of electrons on the substrate 7 can be avoided, and hence the generation of static electricity can be prevented. Therefore, the problem of static electricity in the printing process can be solved.

Compared with the usual method of controlling the printing environment such as temperature and humidity, the screen printing device provided by at least one embodiment of the present disclosure has low cost and high reliability.

Compared with the means adopting ionic wind, the screen printing device provided by at least one embodiment of the present disclosure can well ensure the solvent content and the viscosity in the ink and hence avoid poor printing quality caused by ink setting and viscosity change.

Compared with the means adopting the electrostatic conducting rod, the screen printing device provided by at least one embodiment of the present disclosure may be applicable to the case that the ink is an insulating material.

For example, the electrifying device 2 may adopt the electrifying device in the prior art, as long as the positive voltage or the negative voltage can be provided. For example, the electrifying device 2 may provide positive voltage or negative voltage at different moments. For example, the electrifying device may adopt a voltage source capable of providing positive voltage or negative voltage at different moments.

There are a variety of means to achieve the electric connection between the electrifying device 2 and the conductive mesh 11. One embodiment of the present disclosure provides a means. For example, as illustrated in FIG. 1*a*, the screen plate further includes a conductive screen frame; the conductive mesh 11 is disposed in the conductive screen frame 3 and electrically connected with the conductive screen frame 3; and the conductive screen frame 3 is fixed through a screen frame mounting bracket 4.

Figure 2:
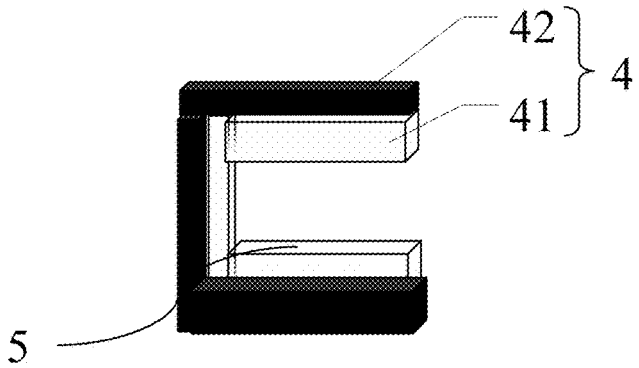
FIG. 2 is a schematic diagram of a screen frame mounting bracket in the screen printing device provided by one embodiment of the present disclosure.

For example, as illustrated in FIGS. 1*a* and 2, the screen frame mounting bracket 4 includes a conductive portion 41 and an insulating portion 42; the electrifying device 2 is electrically connected with the conductive portion 41 of the screen frame mounting bracket 4 through a lead 5; and the conductive portion 41 of the screen frame mounting bracket 4 is electrically connected with the conductive screen frame 3. Therefore, the voltage applied by the electrifying device 2 can be introduced into the conductive mesh 11. For example, the conductive portion 41 may adopt a metal holder, and the insulating portion 42 may be an insulating layer on an external surface of the metal holder. The material of the conductive portion 41 and the insulating portion 42 is not limited in the embodiment, as long as the conductive portion 41 is conductive and the insulating portion 42 can play the role of insulation. The arrangement of the insulating portion for the screen frame mounting bracket 4 can avoid the impact of the electrifying device 4 on the electrical properties of other parts of the printing device. The structure of the screen frame mounting bracket 4 is not limited to the above description and may also adopt other structures. No limitation will be given here in the embodiment of the present disclosure.

Figure 3:
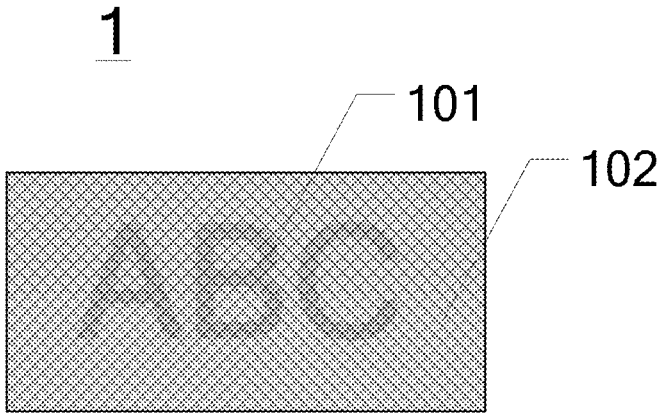
FIG. 3 is a schematic diagram of a screen plate in the screen printing device provided by one embodiment of the present disclosure.

For example, the screen plate 1 may be manufactured by the conventional method. The manufacturing method of the screen plate 1 is not limited in the embodiment of the present disclosure. For example, in one embodiment, the screen plate 1 may, as illustrated in FIG. 3, includes a non-adhesive part 101 and an adhesive part 102. The non-adhesive part 101 corresponds to an area at which a pattern is to be formed. For example, the pattern formed by the screen plate 1 as illustrated in FIG. 1 is ABC. It should be noted that the pattern formed by the screen plate 1 is not limited in the embodiment of the present disclosure. A proper screen plate may be manufactured according to the pattern required to be formed.

For example, in the screen printing process, the polarity of the voltage applied to the conductive mesh 1 by the electrifying device 2 is the first polarity; the polarity of the electrostatic charges on the substrate in the screen printing process when the conductive mesh 11 is not electrified is the second polarity; and the first polarity is opposite to the second polarity. For example, in the screen printing process, the absolute value of the voltage applied to the conductive mesh 11 by the electrifying device 2 is in direct proportion to the quantity of electric charge of the electrostatic charges.

Figure 1B:
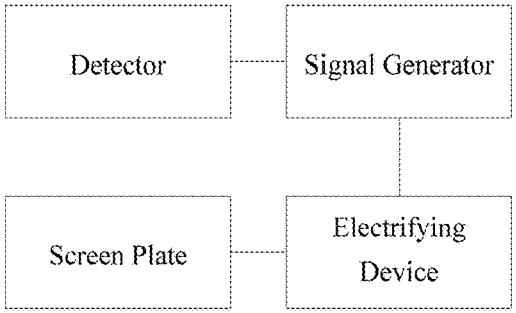
FIG. 1*b* is a block diagram of a screen printing device provided by at least one embodiment of the present disclosure.

FIG. 1*b* is a block diagram of a screen printing device provided by at least one embodiment of the present disclosure. The screen printing device comprises a detector, a signal generator, an electrifying device and a screen plate. More detailed description on the electrifying device and the screen plate may refer to FIG. 1*a* and relevant description thereof.

For example, the signal generator is connected with the electrifying device to control the polarity and the time of the voltage applied to a conductive mesh.

For example, the screen printing device further comprises a bearing table (as illustrated in FIGS. 4-10) for support the substrate in the screen printing process. The bearing table is configured to be grounded.

For example, the signal generator is configured to control the polarity of the voltage applied by the electrifying device in the screen printing process to be opposite to the polarity of the voltage applied in the process of placing the substrate on the bearing table and in the process of separating the substrate from the bearing table.

More detailed description will be given below in the screen printing method to the voltage application means of the electrifying device, for example, the polarity and the time of voltage application.

For example, the detector is configured to detect the polarity and the quantity of electric charge of the electrostatic charges on the substrate in the screen printing process when the conductive mesh is not electrified. It should be noted that the detector here is not a necessary component of the screen printing device, and the electrostatic charges may be detected by an external detector, e.g., an electrostatic tester.

At least one embodiment of the present disclosure further provides a screen printing method, which comprises:

as illustrated in FIG. 4, adopting a printing head 6 to rub against the screen plate 1 to print ink onto the substrate for silk screen printing, in which the screen plate 1 includes a conductive mesh 11; and applying voltage to the conductive mesh 11 in the screen printing process.

For example, as illustrated in FIG. 4, the substrate 7 is placed on the bearing table 8. In the screen printing process, when the printing head 6 rubs against the screen plate 1, static electricity will be produced, and charges may transfer between the substrate 7 and the screen plate 1 (the printing head or the ink).

Figure 5:
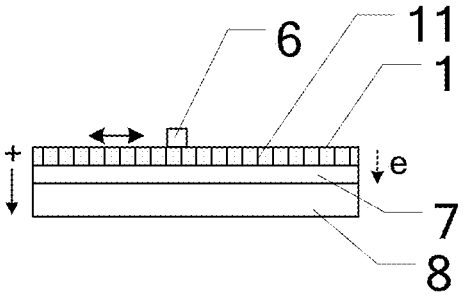
FIG. 5 illustrates the case that a substrate is easy to get electrons and positive voltage is applied to a conductive mesh in the process of adopting the printing head to rub against the screen plate in the screen printing method provided by one embodiment of the present disclosure.

As illustrated in FIG. 5, when the printing head 6 rubs against the screen plate 1, if the substrate 7 is easy to get electrons (it is equivalent that the substrate 7 carries negative charges in the case of producing static electricity), positive voltage is applied to the conductive mesh, so as to prevent the substrate 7 from getting the electrons (under the action of the positive voltage, the electrons which are to be obtained by the substrate 7 are attracted), and hence static electricity can be avoided.

Figure 6:
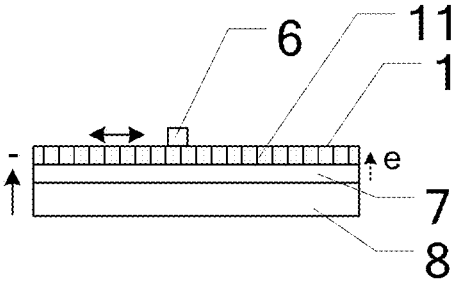
FIG. 6 illustrates the case that the substrate is easy to lose electrons and negative voltage is applied to the conductive mesh in the process of adopting the printing head to rub against the screen plate in the screen printing method provided by one embodiment of the present disclosure.

Similarly, as illustrated in FIG. 6, when the printing head 6 rubs against the screen plate 1, if the substrate 7 is easy to lose electrons (it is equivalent to that the substrate 7 carries positive charges in the case of producing static electricity in the screen printing process), negative voltage may be applied to the conductive mesh, so as to avoid the substrate 7 from losing electrons (under the action of negative voltage, the electrons which are to be lost on the substrate 7 are repelled), and hence static electricity can be avoided.

For example, the charges carried by the screen plate in the case of producing static electricity may be determined according to the material of the ink. When the material of the ink is fixed, the polarity of the voltage applied to the screen plate in the screen printing process may be determined. In actual operation, screen printing may be performed at first when the conductive mesh is not electrified; an electrostatic tester (e.g., an infrared electrostatic tester) is adopted to measure the electrostatic charges on the substrate 7; the polarity of the voltage applied to the screen plate (whether positive voltage or negative voltage is applied) is determined according to the polarity of the electrostatic charges on the substrate 7; and the value of the voltage applied to the screen plate may also be determined according to the amount of the electrostatic charges on the substrate 7. For example, the absolute value of the voltage applied to the conductive mesh in the screen printing process is directly proportional to the quantity of electric charge of the electrostatic charges.

The screen printing method provided by the embodiment of the present disclosure can avoid the generation of static electricity and hence can avoid the influence of static electricity on the substrate. The substrate 7, for example, may be a glass substrate. Moreover, the substrate 7, for example, may be an on-cell touch panel, a solar substrate or the like, but not limited thereto. For example, the on-cell touch panel may include an array substrate, and the array substrate may include thin-film transistors (TFTs), pixel electrodes, etc. When the substrate 7 is an array substrate of a liquid crystal display (LCD) touch panel, the array substrate may further include an alignment film. The array substrate may also be an array substrate of touch display panels of other types and is not limited to the array substrate of the LCD touch panel. For example, the screen printing device provided by the embodiment of the present disclosure may be applied ill the touch panel process to prepare border ink, applied in the solar process to print silver threads, or applied in the on-cell touch panel to print a protective film, but not limited thereto.

For example, in the screen printing method, the conductive mesh includes but not limited to a wire mesh.

For example, positive voltage or negative voltage is applied to the conductive mesh at different moments.

Figure 7:
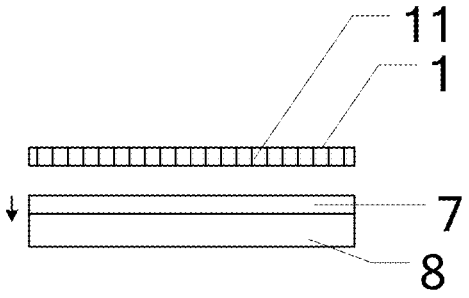
FIG. 7 is a schematic diagram illustrating the contact between the substrate and a bearing table in the screen printing method provided by one embodiment of the present disclosure.
Figure 8:
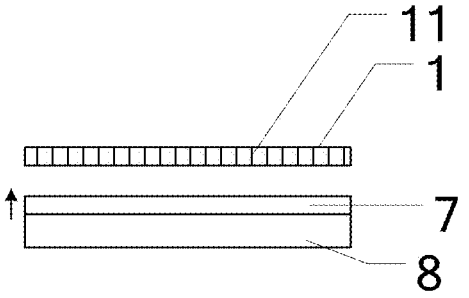
FIG. 8 is a schematic diagram illustrating the separation between the substrate and the bearing table in the screen printing method provided by one embodiment of the present disclosure.

For example, in the process of placing the substrate 7 on the printing stable 8 (as illustrated in FIG. 7) or in the process of separating the substrate 7 from the bearing table 8 (as illustrated in FIG. 8), static electricity may be produced between the substrate 7 and the bearing table 8 (the static electricity is produced by contact), and charges may transfer between the substrate 7 and the bearing table 8. Thus, the substrate 7 carries positive charges or negative charges. Therefore, the screen printing method may further comprise: applying positive voltage or negative voltage to the conductive mesh in the process of placing the substrate 7 on the bearing table 8 (at the moment from non-contact to contact) or in the process of separating the substrate 7 from the bearing table 8 (at the moment of separation).

Figure 9:
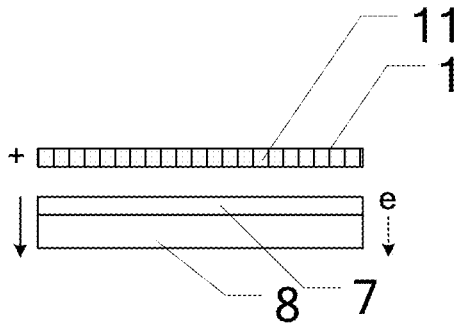
FIG. 9 illustrates the case that the substrate is easy to lose electrons and positive voltage is applied to the conductive mesh at the moment of contact or separation between the substrate and the bearing table in the screen printing method provided by one embodiment of the present disclosure.

As illustrated in FIG. 9, in the process of placing the substrate 7 on the bearing table 8 or in the process of separating the substrate 7 from the bearing table 8, if the substrate 7 is easy to lose electrons, positive voltage may be applied to the conductive mesh, so as to avoid the substrate 7 from losing the electrons.

Figure 10:
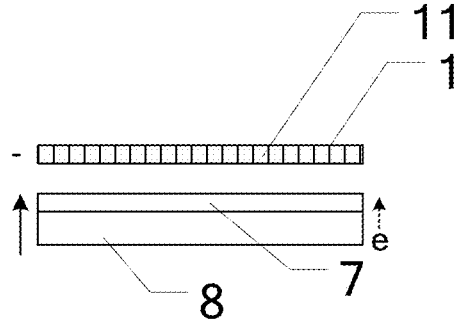
FIG. 10 illustrates the case that the substrate is easy to get electrons and negative voltage is applied to the conductive mesh at the moment of contact or separation between the substrate and the bearing table in the screen printing method provided by one embodiment of the present disclosure.

As illustrated in FIG. 10, in the process of placing the substrate 7 on the bearing table 8 or in the process of separating the substrate 7 from the bearing table 8, if the substrate 7 is easy to get electrons, negative voltage is applied to the conductive mesh, so as to prevent the substrate 7 from getting the electrons. Therefore, the gains and losses of the electrons on the substrate 7 can be avoided, and hence the generation of static electricity can be avoided.

For example, when the material of the bearing table 8 is metal and the substrate 7 is a glass substrate, the substrate 7 is easy to lose electrons. For example, when the material of the bearing table 8 is marble and the substrate 7 is a glass substrate, the substrate 7 is easy to get electrons.

The symbol "+" on the left of FIGS. 5 and 9 represents the application of positive voltage to the conductive mesh, and the solid arrow on the left represents the direction of the electric field line. The symbol "−" on the left of FIGS. 6 and 10 represents the application of negative voltage to the conductive mesh, and the solid arrow on the left represents the direction of the electric field line. The dotted arrow on the right of FIGS. 5 and 10 indicates that the substrate 7 is easy to get electrons, and the dotted arrow on the right of FIGS. 6 and 9 indicates that the substrate 7 is easy to lose electrons.

For example, the property of getting and losing electrons of the substrate 7, in the process of placing the substrate 7 on the bearing table 8 or in the process of separating the substrate 7 from the bearing table 8, is different from the property of getting and losing electrons of the substrate 7 in the screen printing process. Therefore, one of the positive voltage and the negative voltage may be applied to the conductive mesh in the screen printing process; and the other of the positive voltage and the negative voltage is applied to the conductive mesh in the process of placing the substrate 7 on the bearing table 8 or in the process of separating the substrate 7 from the bearing table 8.

For example, in the embodiment of the present disclosure, the polarity, for example, includes positive or negative. The polarity of the positive voltage is positive, and the polarity of the negative voltage is negative. The polarity of positive charges is positive, and the polarity of negative charges is negative.

For example, the screen printing method provided by the embodiment of the present disclosure may adopt the screen printing device provided by the embodiment of the present disclosure for electrifying.

Figure 11:
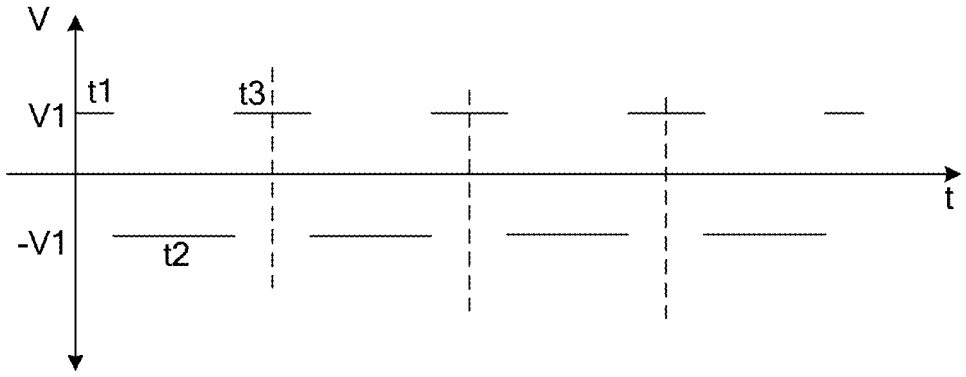
FIG. 11 is a schematic diagram illustrating the voltage applied to the screen plate by an electrifying device at different moments in the mass production process in one embodiment of the present disclosure.

In the mass production process, the voltage applied by the electrifying device may be as illustrated in FIG. 11. Adjacent dotted lines represent one period, namely a complete screen printing process. For example, t1 represents the moment of placing the substrate 7 on the bearing table 8; t2 represents the moment of adopting the printing head to rub against the screen plate for silk screen printing in the screen printing process; and t3 represents the moment of separating the substrate 7 from the bearing table 8.

It should be noted that description is given in FIG. 11 by taking the case that the voltage applied to the screen plate has opposite polarities and equal magnitude (V1, −V1) as an example, and the voltage applied to the screen plate may also be unequal at different moments. No limitation will be given here in the embodiment of the present disclosure. Moreover, negative voltage may also be applied to the screen plate at the moment of placing the substrate on the bearing table and separating the substrate from the bearing table, and positive voltage may also be applied to the screen plate at the moment of adopting the printing head to rub against the screen plate for silk screen printing. The polarity of the voltage applied to the screen plate at the moment of placing the substrate on the bearing table and separating the substrate from the bearing table may also be the same with the polarity of the voltage applied to the screen plate at the moment of adopting the printing head to rub against the screen plate for silk screen printing in the screen printing process. Moreover, the voltage applied to the screen plate may also not be a constant value at the t1, t2 or t3 moment.

As illustrated in FIG. 11, the t2 moment is the screen printing moment, and the t2 and t3 moments are the processes of placing the substrate and separating the substrate (placing and removing processes). As the polarity of static electricity produced by friction in the printing process is generally different from the polarity of static electricity produced by contact in the placing and removing processes, voltage having a polarity opposite to that of the voltage at the t1 and t3 moment is applied at the t2 moment. Even when the polarity of static electricity produced by friction in the printing process is the same with the polarity of static electricity produced by contact in the placing and removing processes, voltage having a polarity opposite to that of the voltage applied at the t1 and t3 moments may also be applied at the t2 moment, so as to avoid electrification by induction.

In addition, as can be seen from FIG. 11, if the placing of the substrate, the screen printing, and the separation of the substrate are repeated for multiple times, alternating voltage (AC) with alternately changed polarities is applied to the conductive mesh by the electrifying device.

The following points should be noted:

(1) Unless other defined, in the embodiments and the accompanying drawings in the disclosure, the same reference number refers to the same feature.

(2) Only the structures relevant to the embodiments of the present disclosure are involved in the accompanying drawings of the embodiments of the present disclosure, and other structures may refer to the conventional design.

(3) For clarity, the thickness of layers or areas in the accompanying drawings of the embodiments of the present disclosure is enlarged. It should be understood that when an element such as a layer, a film, an area or a substrate is referred to be disposed "on" or "beneath" another element, the element may be "directly" disposed "on" or "beneath" another element, or an intermediate element may be provided.

(4) Features in a same embodiment or different embodiments in the disclosure may be mutually combined without conflict.

The foregoing is only the specific embodiments of the present disclosure and not intended to limit the scope of protection of the present disclosure. Any change or replacement that may be easily thought of by those skilled in the art within the technical scope disclosed by the present disclosure shall fall within the scope of protection of the present disclosure. Therefore, the scope of protection of the present disclosure shall be defined by the appended claims.

The application claims priority to the Chinese patent application No. 201610728846.6, filed Aug. 25, 2016, the disclosure of which is incorporated herein by reference as part of the application.

The invention claimed is:

1. A screen printing method, comprising:

adopting a printing head to rub against a screen plate to print ink onto a substrate for silk screen printing, wherein the screen plate includes a conductive mesh; and applying voltage to the conductive mesh in the screen printing process; and further comprising: applying positive voltage or negative voltage to the conductive mesh in a process of placing the substrate on a bearing table and/or in a process of separating the substrate from the bearing table, wherein voltages with different polarities are respectively applied to the conductive mesh at different moments.

2. The screen printing method according to claim 1, wherein one of the positive voltage and the negative voltage is applied to the conductive mesh in the screen printing process.

3. The screen printing method according to claim 2, wherein the other of the positive voltage and the negative voltage is applied to the conductive mesh in the process of placing the substrate on the bearing table and in the process of separating the substrate from the bearing table.

4. The screen printing method according to claim 1, wherein, in a screen printing process, a polarity of the voltage applied to the conductive mesh by an electrifying device is a first polarity; a polarity of electrostatic charges on a substrate in the screen printing process upon the conductive mesh being not electrified is a second polarity; and the first polarity is opposite to the second polarity.

5. The screen printing method according to claim 4, wherein, in the screen printing process, an absolute value of the voltage applied to the conductive mesh by the electrifying device is directly proportional to a charge quantity of the electrostatic charges.

6. The screen printing method according to claim 1, wherein the bearing table is grounded.

7. The screen printing method according to claim 1, further comprising detecting charge quantity of electrostatic charges on the substrate in the screen printing process upon the conductive mesh being not electrified.

8. A screen printing method, comprising:

adopting a printing head to rub against a screen plate to print ink onto a substrate for silk screen printing, wherein the screen plate includes a conductive mesh; and applying voltage to the conductive mesh in the screen printing process; and further comprising: before applying the voltage to the conductive mesh, adopting the ink for silk screen printing upon the conductive mesh being not electrified, and measuring the polarity of electrostatic charges on the substrate.

9. The screen printing method according to claim 8, wherein the polarity of the voltage applied to the conductive mesh in the screen printing process is opposite to the polarity of the electrostatic charges.

10. The screen printing method according to claim 8, wherein an absolute value of the voltage applied to the conductive mesh in the screen printing process is directly proportional to the charge quantity of the electrostatic charges.

11. The screen printing method according to claim 8, wherein, in a screen printing process, a polarity of the voltage applied to the conductive mesh by an electrifying device is a first polarity; a polarity of electrostatic charges on a substrate in the screen printing process upon the conductive mesh being not electrified is a second polarity; and the first polarity is opposite to the second polarity.

12. The screen printing method according to claim 11, wherein, in the screen printing process, an absolute value of the voltage applied to the conductive mesh by the electrifying device is directly proportional to a charge quantity of the electrostatic charges.

13. The screen printing method according to claim 8, wherein one of the positive voltage and the negative voltage is applied to the conductive mesh in the screen printing process.

14. The screen printing method according to claim 13, wherein the other of the positive voltage and the negative voltage is applied to the conductive mesh in the process of placing the substrate on a bearing table and in the process of separating the substrate from the bearing table.

15. The screen printing method according to claim 14, wherein the bearing table is grounded.

16. The screen printing method according to claim 8, further comprising detecting charge quantity of the electrostatic charges on the substrate in the screen printing process upon the conductive mesh being not electrified.

* * * * *